US007438023B2

(12) United States Patent
Lee et al.

(10) Patent No.: US 7,438,023 B2
(45) Date of Patent: Oct. 21, 2008

(54) HEATING DEVICE HAVING A THERMAL CUT-OFF CIRCUIT FOR A FUEL LINE AND METHOD OF OPERATING THE SAME

(75) Inventors: Hyungsik Lee, Mequon, WI (US); Dennis R. Hughes, Hartford, WI (US)

(73) Assignee: AOS Holding Company, Wilmington, DE (US)

( * ) Notice: Subject to any disclaimer, the term of this patent is extended or adjusted under 35 U.S.C. 154(b) by 331 days.

(21) Appl. No.: 11/422,764

(22) Filed: Jun. 7, 2006

(65) Prior Publication Data

US 2007/0284000 A1 Dec. 13, 2007

(51) Int. Cl.
*F23N 1/08* (2006.01)

(52) U.S. Cl. ..... 122/14.22; 122/14.21; 122/14.2; 236/21 B

(58) Field of Classification Search ..... 122/14.1, 122/14.2, 14.21, 14.22; 236/21 B; 126/344, 126/361.1

See application file for complete search history.

(56) References Cited

U.S. PATENT DOCUMENTS 3,902,351 A * 9/1975 Kreps ..... 374/1
4,470,541 A * 9/1984 Raleigh ..... 236/21 B
6,497,200 B2 12/2002 Stretch et al.
6,540,504 B2 4/2003 Kobayashi et al.
6,684,821 B2 * 2/2004 Lannes et al. ..... 122/14.2
6,715,451 B2 4/2004 Stretch et al.
6,776,125 B2 8/2004 Stretch et al.
6,877,462 B2 * 4/2005 Adams et al. ..... 122/14.1
6,893,253 B2 5/2005 Stretch et al.
6,901,886 B2 6/2005 Lesage
6,957,628 B2 10/2005 Stretch et al.
6,964,248 B2 * 11/2005 Stretch et al. ..... 122/14.2
7,222,591 B1 * 5/2007 Peart et al. ..... 122/14.31
7,293,718 B2 * 11/2007 Sigafus et al. ..... 236/11

* cited by examiner

*Primary Examiner*—Gregory A Wilson
(74) *Attorney, Agent, or Firm*—Michael Best & Friedrich LLP

(57) ABSTRACT

A thermal cut-off circuit for a gas-fired device and method of operating the circuit. The thermal cut-off circuit includes a thermal cut-off switch and an ambient thermal switch. The thermal cut-off switch is positioned in a combustion chamber and the ambient thermal switch is preferably positioned in a flow of air entering the combustion chamber. The thermal cut-off circuit ensures a gas valve is closed upon detecting a possible incomplete combustion in the combustion chamber.

31 Claims, 6 Drawing Sheets

HEATING DEVICE HAVING A THERMAL CUT-OFF CIRCUIT FOR A FUEL LINE AND METHOD OF OPERATING THE SAME

BACKGROUND

The invention relates to heating devices, and particularly, to gas heating devices. More particularly, the invention relates to safety circuits for controlling gas heating devices.

Gas-fired heating devices, such as water heaters, often include a combustion chamber and air plenum disposed below a tank, such as a water tank. A gas manifold tube, an ignition source, a thermocouple, and a pilot tube typically extend into the combustion chamber. When the temperature of the water in the tank falls below a set minimum, fuel is introduced into the combustion chamber through the gas manifold tube and a burner element. This fuel is ignited by a pilot burner flame or the ignition source, and the flame is maintained around the burner element. Air is drawn into the plenum via an air inlet, and mixes with the fuel to support combustion within the combustion chamber. The products of combustion typically flow through a flue or heat exchange tube in the water tank to heat the water by conduction.

SUMMARY

In one embodiment, the invention provides a gas water heater comprising a combustion chamber including a burner, a gas valve coupled to the burner, a power source, and a thermal cut-off circuit. The thermal cut-off circuit includes a thermal cut-off switch and an ambient thermal switch. The thermal cut-off switch is positioned in the combustion chamber. The thermal cut-off switch and the ambient thermal switch are electrically connected in parallel between the power source and the gas valve.

The thermal cut-off switch is configured to open when a temperature in the combustion chamber exceeds a first threshold and the ambient thermal switch is configured to close when a temperature of air exceeds a second threshold.

In another embodiment the invention provides a thermal cut-off circuit for use in a gas water heater. The water heater includes a combustion chamber having a burner, a gas valve, and a power source. The thermal cut-off circuit includes a thermal cut-off switch configured to open an electrical connection between the power source and the gas valve when the temperature in the combustion chamber is greater than a first threshold. The thermal cut-off circuit further includes an ambient thermal switch configured to electrically connect the power source to the gas valve when an ambient temperature of air is greater than a second threshold. A lack of an electrical connection between the power source and the gas valve ensures the gas valve is closed.

In another embodiment the invention provides a method of controlling a gas water heater. The water heater includes a combustion chamber, a power source, a gas valve, and a thermal cut-off circuit. The thermal cut-off circuit has a thermal cut-off switch and an ambient thermal switch. The method includes the steps of providing power to the gas valve, detecting a first temperature in the combustion chamber, determining if the first temperature exceeds a first threshold, detecting a second temperature of air entering the combustion chamber, determining if the second temperature exceeds a second threshold, and ensuring the gas valve is closed when the first temperature exceeds the first threshold and the second temperature does not exceed the second threshold.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
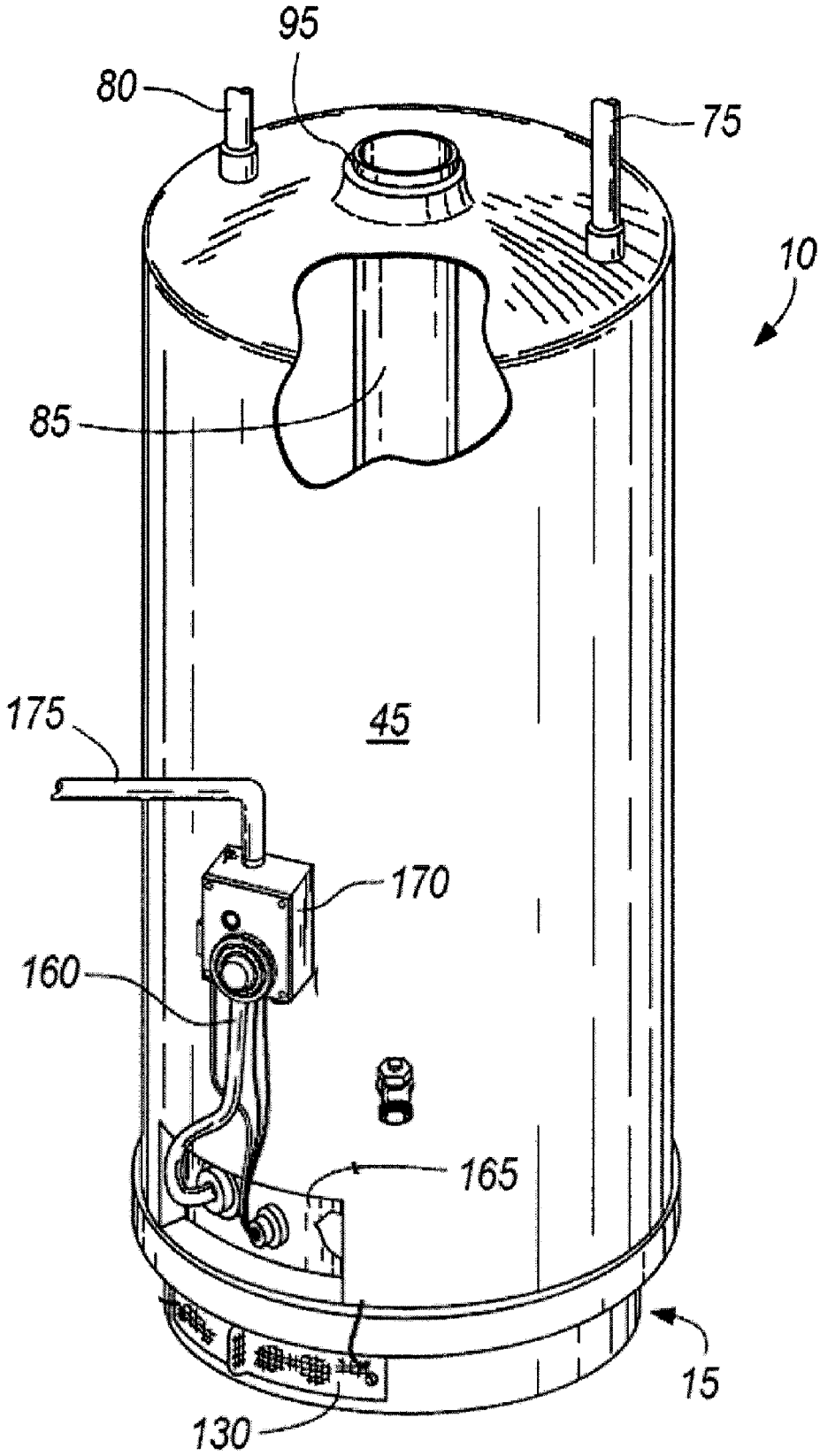
FIG. 1 is a perspective view of an exemplary construction of a water heater.
Figure 2:
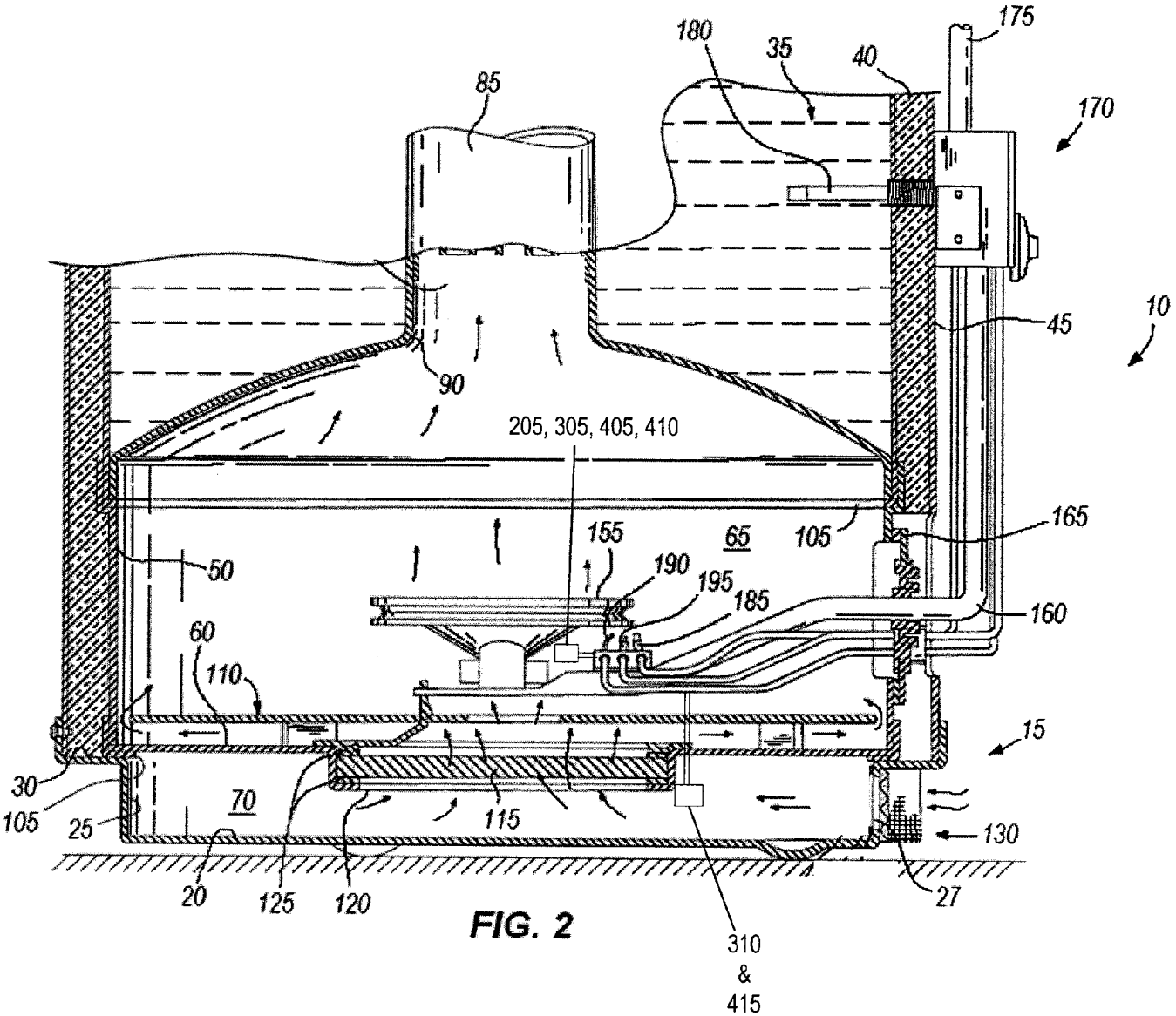
FIG. 2 is a sectional view of the bottom portion of the water heater of FIG. 1.

FIGS. 1 and 2 show an exemplary construction of a water heater having a non-powered gas valve/thermostat. As used in reference with FIGS. 1 and 2, the term "non-powered gas valve/thermostat" refers to a gas valve/thermostat that is not powered by the electrical mains however and as will become more apparent below, the non-powered gas valve/thermostat is powered by one or more local power sources. Furthermore, it is contemplated that the gas valve/thermostat may be connected to the electrical mains in some constructions of the water heater.

FIGS. 1 and 2 illustrate a storage-type gas-fired water heater 10 that includes a base pan 15 for providing the primary structural support for the rest of the water heater 10. The base pan 15 may be constructed of stamped metal or molded plastic, for example, and includes a generally horizontal bottom wall 20, a vertical rise 25 having an air inlet opening 27, and an elevated step 30. The water heater 10 also includes a water tank 35, insulation 40 surrounding the tank 35, and an outer jacket 45 surrounding the insulation 40 and the water tank 35. A skirt 50 is supported by the base pan's elevated step 30 and in turn supports the water tank 35. The elevated step 30 also supports the insulation 40 and jacket 45.

In addition, the elevated step 30 supports a divider 60 that divides the space between the bottom of the tank 35, skirt 50, and the base pan 1 5 into a combustion chamber 65 (above the divider 60) and plenum 70 (below the divider 60).

A cold water inlet tube 75 and a hot water outlet tube 80 extend through a top wall of the water tank 35. A flue 85 extends through the tank 35, and water in the tank 35 surrounds the flue 85. The flue 85 includes an inlet end 90 and an outlet end 95.

The combustion chamber 65 and plenum 70 space are substantially air-tightly sealed, except for the air inlet opening 27 and inlet end 90 of the flue 85. Seals 105 between the skirt 50 and the tank 35 and base pan 15 assist in sealing the space. The seals 105 may be, for example and without limitation, fiberglass material or a high-temperature caulk material. A radiation shield 110 sits on the divider 60 within the sealed combustion chamber 65 and reflects radiant heat up toward the tank 35.

A flame arrester 115 is affixed in a sealed condition across an opening 120 in the divider 60 such that all air flowing from the plenum 70 into the combustion chamber 65 should flow through the flame arrester 115. The air inlet 27, air plenum 70, and opening 120 in the divider 60 together define an air intake for the combustion chamber 65, and all air flowing into the combustion chamber 65 through the opening (see arrows in FIG. 2) 120 should flow through this air intake and the flame arrester 115. It should also be noted that the position and orientation of the flame arrester 115 are not limited to those shown in the drawings, and that substantially any construction will work provided that the flame arrester 115 acts as the gateway for the air flowing into the combustion chamber 65 from the plenum 70. Sealing members 125 seal the periphery of the flame arrester 115 to the divider 60 to reduce the likelihood of air circumventing the flame arrester 115. In alternative constructions, a single sealing member 125 may be used to seal the flame arrester 115 with respect to the divider 60, or if the flame arrester fits snugly against the divider 60, no sealing members 125 may be needed. The flame arrester 15 prevents flame within the combustion chamber 65 from igniting flammable vapors outside of the combustion chamber 65.

With reference again to FIG. 2, the air inlet 27 is covered by a lint, dust, and oil ("LDO") filter 130 mounted to the outer surface of the base pan 15. The LDO filter 130 filters air flowing into the plenum 70 and reduces the likelihood that the flame arrester 115 will become occluded by lint or other debris.

A main burner 155 in the combustion chamber 65 burns a mixture of fuel and air to create the products of combustion that flow up through the flue 85 to heat the water in the tank 35. The main burner 155 receives fuel through a gas manifold tube 160 that extends in a sealed condition through an access door 165 mounted in a sealed condition over an access opening in the skirt 50.

The construction shown (illustrated in FIGS. 1 and 2), employs a non-powered gas valve/thermostat 170 mounted to the water tank 10. A gas main 175 provides fuel to the input side of the gas valve/thermostat 170. The gas valve/thermostat 170 includes a water temperature probe 180 threaded into the tank side wall 35. Connected to the output side of the gas valve/thermostat 170 are the burner manifold tube 160, a pilot burner 185, a thermocouple 190, and a spark igniter 195. The pilot burner 185, thermocouple 190, and spark igniter 195 extend into the combustion chamber 65 in a sealed condition through a grommet in the access door 165.

The gas valve/thermostat 170 provides a flow of fuel to the pilot burner 185 to maintain a standing pilot burner flame, and this construction is therefore generally referred to as a "continuous pilot ignition" system. The spark igniter 195 is used to initiate flame on the pilot burner 185 without having to reach into the combustion chamber with a match. A spark is generated by the spark igniter 195 in response to pushing a button on the gas valve/thermostat 170. The thermocouple 190 provides feedback to the gas valve/thermostat 170 as to the presence of flame at the pilot burner 185. More specifically, the gas valve/thermostat 170 includes an interrupter valve or some other means for selectively shutting off fuel flow to the pilot burner 185 and main burner 155. The interrupter valve is biased toward a closed position. The interrupter valve is held open by a voltage arising in the thermocouple 190 in response to the tip of the thermocouple 190 being heated by the pilot burner flame. If the pilot burner 185 loses its flame, the thermocouple 190 will cool down and not provide the voltage to the interrupter valve, and the interrupter valve will close and shut off fuel flow to the pilot burner 185 and main burner 155.

The gas valve/thermostat 170 permits fuel to flow to the main burner 155 in response to a water temperature sensor (e.g., the water temperature probe 180) indicating that the water temperature in the water tank 35 has fallen below a selected temperature. When fuel flows to the main burner 155, it is mixed with air and the mixture is ignited when it contacts the pilot burner flame. Once the water temperature sensor indicates that the water has reached the desired temperature, the gas valve/thermostat 170 shuts off fuel flow to the main burner 155, and the water heater 10 is in "standby mode" until the water temperature again drops to the point where the gas valve/thermostat 170 should again provide fuel to the main burner 155.

The LDO filter 130 filters dirt and debris out of the air as the air passes through the LDO filter 130. The dirt and debris builds up on the LDO filter 130 and eventually can restrict the flow of air through the LDO filter 130 and into the plenum 70 and the combustion chamber 65. The reduction of air flowing into the combustion chamber 65 can result in the main burner 155 not completely combusting the fuel provided to the main burner 155. The incomplete combustion can result in the production of carbon monoxide ("CO") gas. Therefore, it is desirable to detect when the LDO filter 130 is preventing sufficient air from entering the combustion chamber 65 to enable complete combustion.

Figure 3:
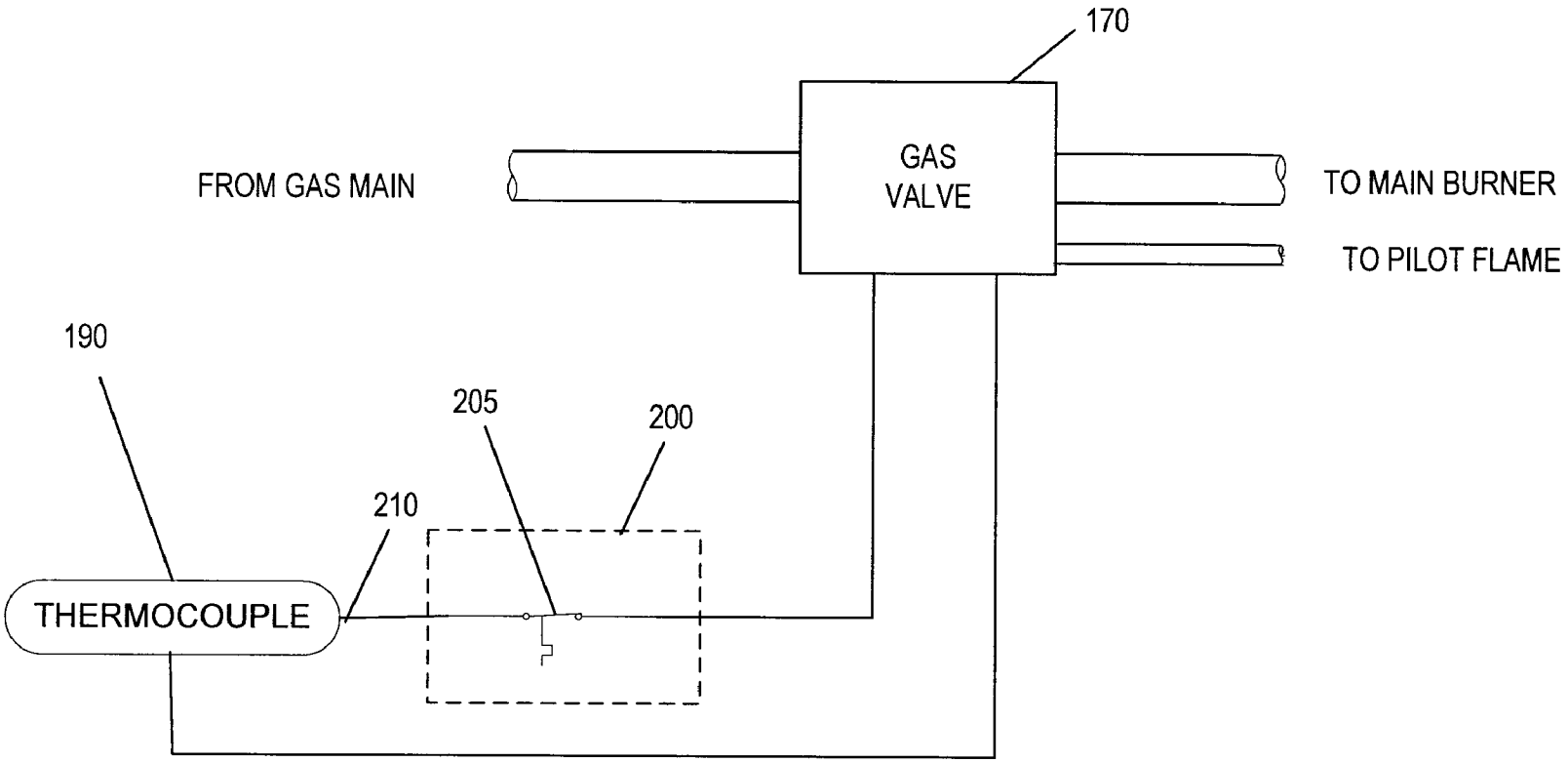
FIG. 3 PRIOR ART
FIG. 3 is a partial block diagram/partial schematic of a first construction of a thermal cut-off circuit.

Incomplete combustion causes a flame produced by the main burner 155 to flatten and to generate excess heat. Detection of this excess heat can indicate that combustion is incomplete. FIG. 3 is an illustration of a prior art construction of a thermal cut-off circuit 200 for detecting excess heat in the combustion chamber 65 and terminating the flow of fuel to the main burner 155 and pilot burner 185. The thermal cut-off circuit 200 includes a thermal cut-off switch 205 connected between a negative terminal 210 of the thermocouple 190 and a terminal 215 of the gas valve/thermostat 170. The thermal cut-off switch 205 is typically mounted in the combustion chamber 65 generally below the main burner 155 as shown in FIG. 2.

The thermal cut-off switch 205 is a normally closed switch which opens when it detects a temperature above a threshold (e.g., 180-220 degrees Celsius). The thermal cut-off switch 205 is chosen such that its threshold is above the normal operating temperature in the combustion chamber 65. It is desirable to have a threshold as low as possible in order to detect incomplete combustion as quickly as possible. Under normal operation, the thermocouple 190 is located in the pilot flame and provides voltage to the gas valve 170 to hold the interrupter valve open as explained above. When air flow to the combustion chamber 65 becomes restricted, because the LDO filter 130 is dirty for example, the flame from the main burner 155 flattens out and the temperature in the combustion chamber 65 rises above the threshold of the thermal cut-off switch 205. The thermal cut-off switch 205 then opens and the voltage to the gas valve 1770 is blocked causing the interrupter valve to close and shut off fuel to the main burner 155 and the pilot burner 185. Since the fuel to the pilot burner 185 is shut off, the pilot flame extinguishes removing heat from the thermocouple 190. Once the combustion chamber 65 cools down below the threshold, the thermal cut-off switch 205 closes. However, because the thermocouple 190 is not being heated by the pilot flame, the gas valve 170 is not receiving any voltage and therefore cannot hold the interrupter valve open. Accordingly, the pilot flame must be relit before the water heater 10 can function again. If the LDO filter 130 is not cleaned, incomplete combustion will occur again and the thermal cut-off circuit 200 again closes the interrupter valve.

The temperature in the combustion chamber 65 is influenced by the main burner 155 and the pilot flame. In addition, the temperature in the combustion chamber 65 can also be influenced by the temperature of the ambient air entering the plenum 70. A relatively high ambient temperature can raise the temperature in the combustion chamber 65. If the threshold of the thermal cut-off switch 205 is chosen too low, using the water heater in the presence of a high ambient temperature can result in the thermal cut-off circuit 200 closing the interrupter valve during times when there is sufficient air entering the combustion chamber 65 and combustion is complete (a "false shut-off"). Choosing a thermal cut-off switch 205 with a higher threshold can prevent false shut-offs as a result of high ambient temperatures. However, the higher threshold can result in incomplete combustion being undetected when the ambient temperature is low.

Figure 4:
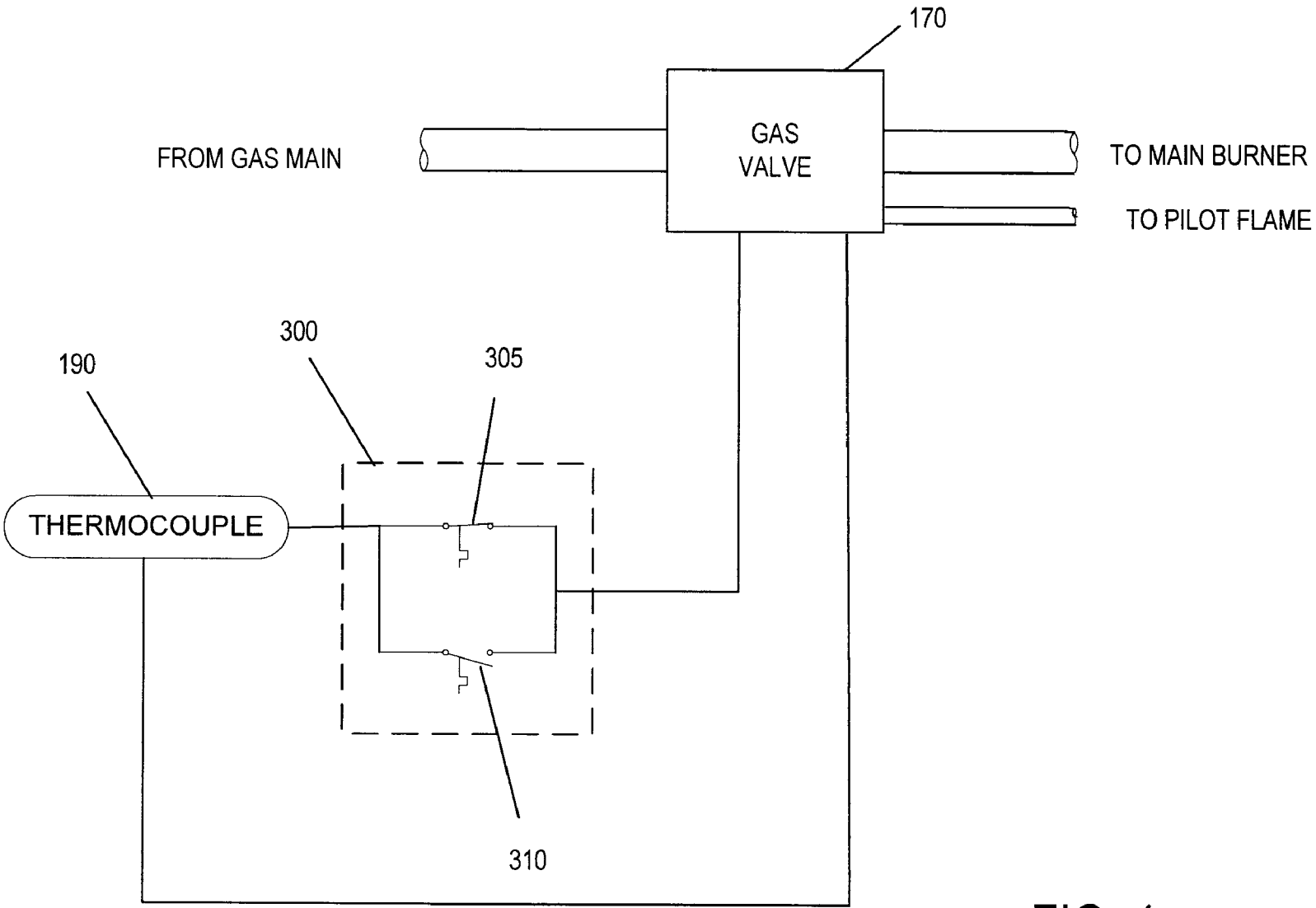
FIG. 4 is a partial block diagram/partial schematic of a second construction of a thermal cut-off circuit.

FIG. 4 is an illustration of a schematic of a construction of a thermal cut-off circuit 300 which prevents the interrupter valve from being closed when there is a high ambient temperature. The thermal cut-off circuit 300 includes a thermal cut-off switch 305 and an ambient thermal switch 310. The ambient thermal switch 310 is connected in parallel to the thermal cut-off switch 305 and is mounted in the plenum 70 in the path of air entering the combustion chamber 65 (as shown in FIG. 2). In some other constructions, the ambient thermal switch 310 is mounted external to the water heater 10. The ambient thermal switch 310 is a normally open switch which closes when it is exposed to a temperature above an ambient threshold (e.g., 95-125 degrees Fahrenheit).

During normal operation, the thermal cut-off circuit 300 functions similar to the thermal cut-off circuit 200 of FIG. 3. However, when the ambient temperature exceeds the ambient threshold, the ambient thermal switch 310 closes. If the thermal cut-off switch 305 detects excess heat in the combustion chamber 65 and opens when the ambient temperature is high, the ambient thermal switch 310 overrides the thermal cut-off switch 305 and maintains the electrical connection between the thermocouple 190 and the gas valve 170. Thus, the ambient thermal switch 310 prevents a false shut off due to high ambient temperature. Because a high ambient temperature does not cause a false shut off, the threshold of the thermal cut-off switch 305 can be chosen closer to the normal operating temperature in the combustion chamber 65 and incomplete combustion conditions can be detected relatively quickly.

Since, when a high ambient temperature exists, the ambient thermal switch 310 overrides the thermal cut-off switch 305, if the water heater 10 is located in an area which commonly has high ambient temperatures, the effectiveness of the thermal cut-off circuit 300 is reduced. For example, if incomplete combustion occurs when a high ambient temperature exists, the thermal cut-off circuit 300 does not block the voltage from the thermocouple 190 to the gas valve 170. Therefore, during periods of high ambient temperature, the thermal cut-off circuit 300 does not stop the flow of fuel to the main burner 155, even if an incomplete combustion condition exists.

Figure 5:
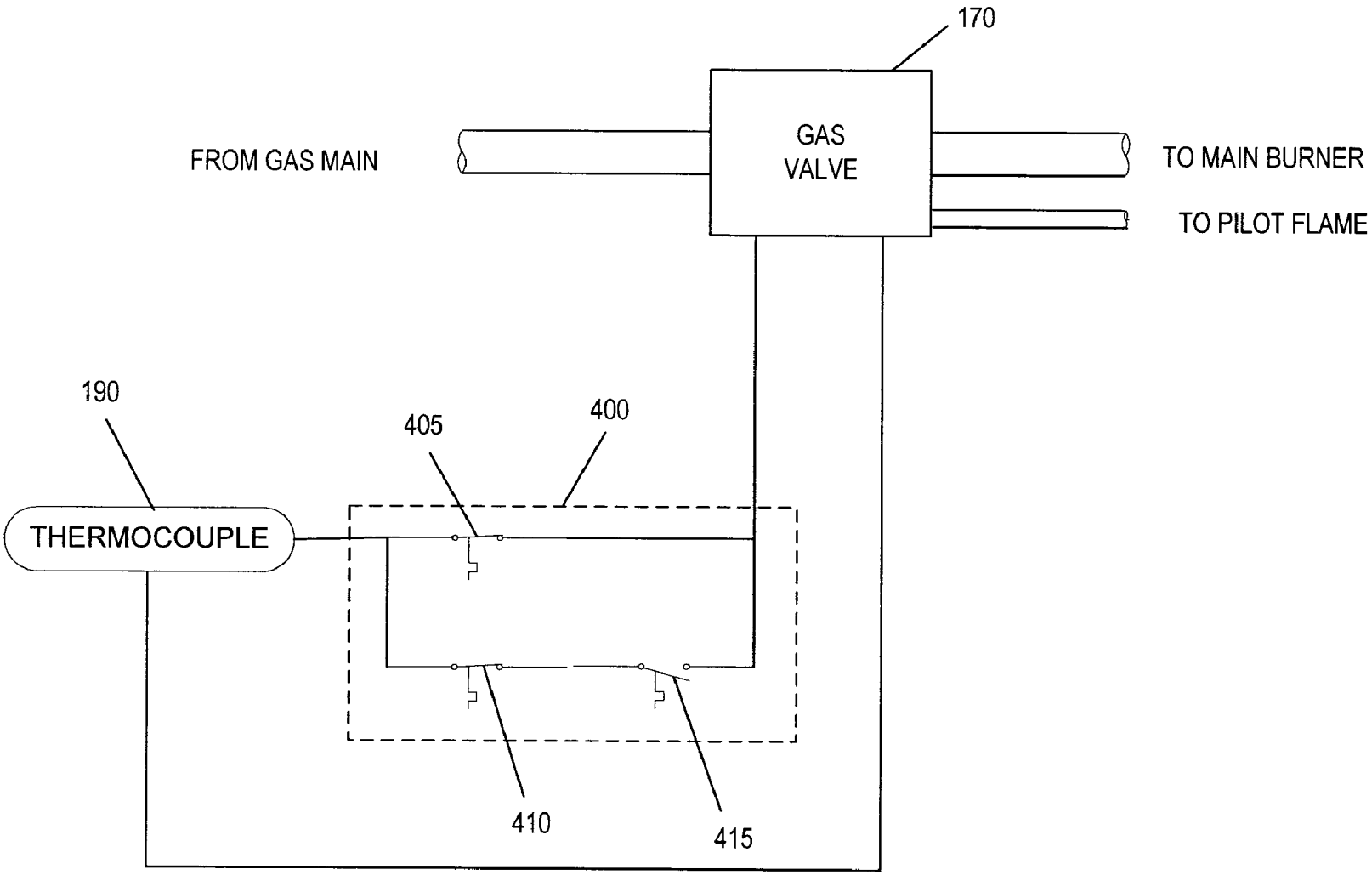
FIG. 5 is a partial block diagram/partial schematic of a third construction of a thermal cut-off circuit.

FIG. 5 is an illustration of a construction of a thermal cut-off circuit 400 which can prevent false shut-offs due to high ambient temperature and also ensure the flow of fuel to the main burner 155 is shut off when incomplete combustion occurs during a period of high ambient temperature. The thermal cut-off circuit 400 includes a first thermal cut-off switch 405 having a first temperature threshold (e.g., 180-220 degrees Celsius), a second thermal cut-off switch 410 having a second temperature threshold greater than the first temperature threshold (e.g., 200-240 degrees Celsius), and an ambient temperature switch 415 having an ambient threshold (e.g., 95-125 degrees Fahrenheit). The first and second thermal cut-off switches 405 and 410 are mounted in the combustion chamber 65 below the main burner 155 (as shown in FIG. 2). The ambient thermal switch 415 is mounted in the plenum 70 in the path of air entering the combustion chamber 65. However, other locations for the first and second thermal cut-off switches 405 and 410 and the ambient thermal switch 415 are possible. The ambient thermal switch 415 and the second thermal cut-off switch 410 are connected in series with one another and in parallel with the first thermal cut-off switch 405.

Figure 6:
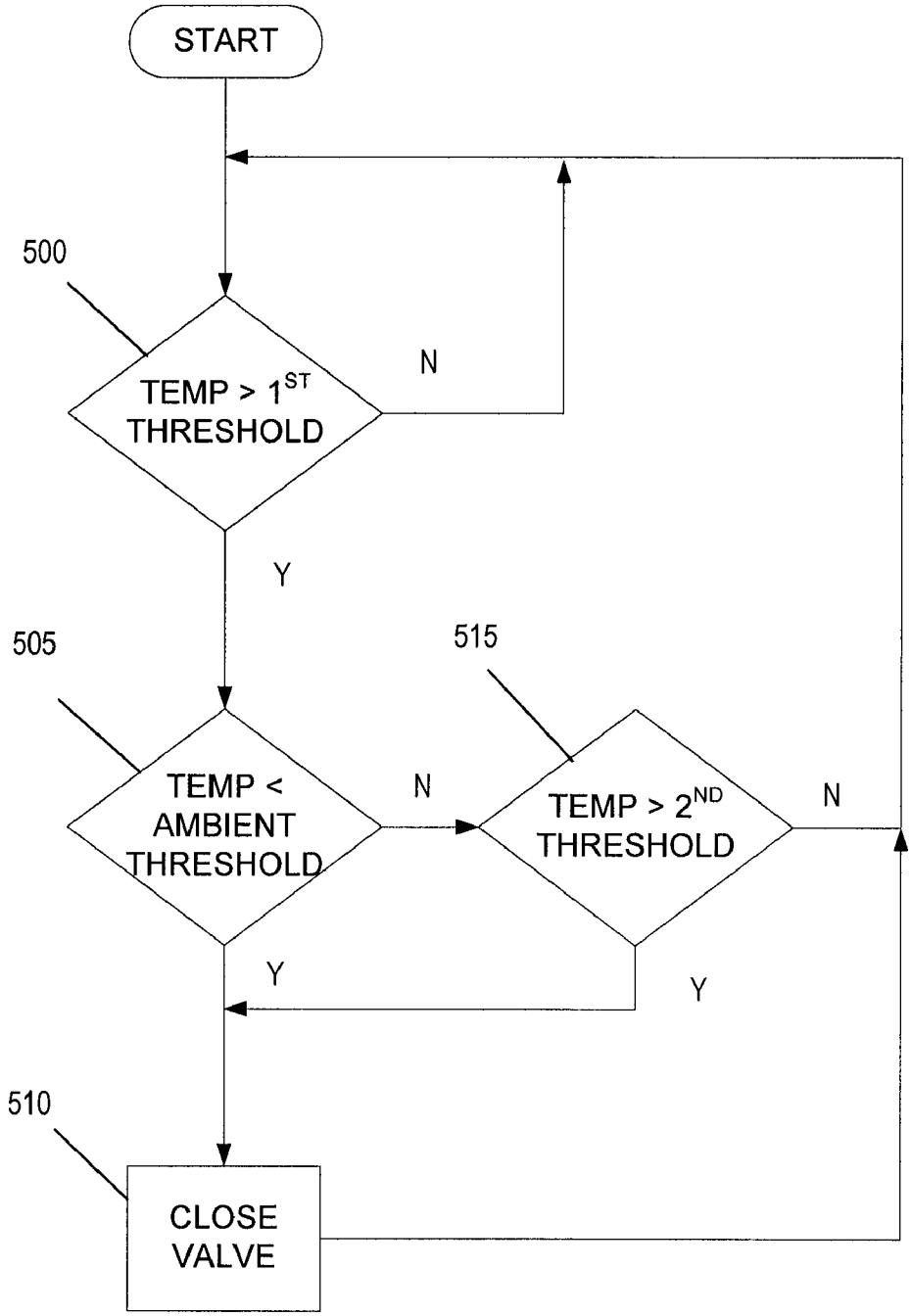
FIG. 6 is a flow chart of the operation of the thermal cut-off circuit of FIG. 5.

FIG. 6 is a flow chart illustrating the operation of the thermal cut-off circuit 400 shown in FIG. 5. If the temperature in the combustion chamber 65 is less than the first temperature threshold (block 500), the first thermal cut-off switch 405 is closed and the water heater 10 operates normally. If the temperature in the combustion chamber 65 is greater than the first temperature threshold (block 500), the first thermal cut-off switch 405 is open. If the ambient temperature is less than the ambient threshold (block 505), the ambient thermal switch 415 is open and the electrical connection between the thermocouple 190 and the gas valve 170 is open. Because both parallel paths between the thermocouple 190 and the gas valve 170 are open, the gas valve 170 is not receiving a voltage from the thermocouple 190 and the interrupter valve closes (block 510) shutting off fuel to the main burner 155 and the pilot burner 185. Since the fuel to the pilot burner 185 is shut off, the pilot flame extinguishes removing heat from the thermocouple 190. Once the combustion chamber 65 cools down below the threshold, the thermal cut-off switches 405 and 410 close. However, because the thermocouple 190 is not being heated by the pilot flame, the gas valve 170 is not receiving any voltage and therefore cannot hold the interrupter valve open. Accordingly, the pilot flame must be relit before the water heater 10 can function again. If the LDO filter 130 is not cleaned, incomplete combustion will occur again and the thermal cut-off circuit 400 again closes the interrupter valve.

If the ambient temperature is greater than the ambient threshold (block 505), the ambient thermal switch 415 is closed. If the temperature in the combustion chamber 65 is less than the second temperature threshold (block 515), the second thermal cut-off switch 410 is closed and the thermocouple 190 is connected to the gas valve 170 and the water heater 10 operates normally. If the temperature in the combustion chamber 65 is greater than the second temperature threshold (block 515), the second thermal cut-off switch 410 is open. Because both parallel paths between the thermocouple 190 and the gas valve 170 are open, the electrical connection between the thermocouple 190 and the gas valve 170 is open. Therefore, the gas valve 170 is not receiving a voltage from the thermocouple 190 and the interrupter valve closes (block 510) shutting off fuel to the main burner 155 and the pilot burner 185 as described above.

While the thermal cut-off circuit has been described in relation to a water heater, the thermal cut-off circuit has application in any gas-fired device including a furnace, a stove, and a boiler. Further, the thermal cut-off circuit is not limited to gas-fired devices incorporating a pilot burner and associated circuit. Instead the thermal cut-off circuit can be power by a battery or external power source and can interrupt the main flow of fuel to the device. In addition, the thermal cut-off circuit can be used in any device in which a flow of fuel is required, including propane (e.g., barbeque grills) and gasoline (e.g., automobiles).

Thus, the invention provides, among other things, a thermal cut-off circuit for devices requiring a fuel supply. Various features and advantages of the invention are set forth in the following claims.

The invention claimed is:

1. A gas water heater comprising:

a combustion chamber including a burner;

a gas valve coupled to the burner;

a power source; and a thermal cut-off circuit comprising a thermal cut-off switch positioned in the combustion chamber, electrically coupled in a first current path between the power source and the gas valve, the thermal cut-off switch configured to open when a temperature in the combustion chamber exceeds a first threshold, and an ambient thermal switch electrically coupled in a second current path having a parallel relation to the first current path, the ambient thermal switch configured to close when a temperature of air exceeds a second threshold.

2. The gas water heater of claim 1 and further comprising a second thermal cut-off switch positioned in the combustion chamber, electrically coupled in the second current path, and electrically coupled in series with the ambient thermal switch, the second thermal cut-off switch configured to open when the temperature in the combustion chamber exceeds a third threshold, the third threshold greater than the first threshold.

3. The gas water heater of claim 2 wherein the second thermal cut-off switch is positioned below the burner.

4. The gas water heater of claim 2 wherein the third threshold is about 200-240 degrees Celsius.

5. The gas water heater of claim 1 wherein the second threshold is lower than the first threshold.

6. The gas water heater of claim 1 wherein the first thermal cut-off switch is positioned below the burner.

7. The gas water heater of claim 1 wherein the ambient thermal switch is positioned in a plenum.

8. The gas water heater of claim 1 wherein the first threshold is about 108-220 degrees Celsius.

9. The gas water heater of claim 1 wherein the second threshold is about 95-125 degrees Fahrenheit.

10. The gas water heater of claim 1 and further comprising a pilot light being operable to produce a flame; and a pilot circuit comprising a thermocouple thermally coupled to the pilot light and electrically coupled to the gas valve, the pilot circuit being configured to ensure the gas valve is closed in response to the flame extinguishing.

11. The gas water heater of claim 10 wherein the power source is the thermocouple.

12. The gas water heater of claim 1 wherein the thermal cut-off circuit ensures the gas valve is closed when a possible incomplete combustion condition exists.

13. The gas water heater of claim 1 wherein the ambient thermal switch is positioned in a path of air entering the combustion chamber.

14. A thermal cut-off circuit for use in a gas appliance including a combustion chamber, a burner, a gas valve, and a power source, the thermal cut-off circuit comprising:

a thermal cut-off switch configured to open an electrical connection between the power source and the gas valve when a temperature in the combustion chamber is greater than a first threshold;

an ambient thermal switch configured to electrically connect the power source to the gas valve when an ambient temperature of air is greater than a second threshold; and wherein the absence of electrical connections for the thermal cut-oft switch and the ambient thermal switch ensures the gas valve is closed.

15. The thermal cut-off circuit of claim 14 and further comprising a second thermal cut-off switch configured to open the electrical connection between the thermocouple and the gas valve created by the ambient thermal switch when the temperature in the combustion chamber is greater than a third threshold, the third threshold greater than the first threshold, wherein the absence of electrical connections for the thermal cut-off switch and the second thermal cut-off switch ensures the gas valve is closed.

16. The thermal cut-off circuit of claim 15 wherein the second thermal cut-off switch is positioned below a main burner.

17. The thermal cut-off circuit of claim 14 wherein the second threshold is lower than the first threshold.

18. The thermal cut-off circuit of claim 14 wherein the first thermal cut-off switch is positioned below a main burner.

19. The thermal cut-off circuit of claim 14 wherein the ambient thermal switch is positioned in a plenum.

20. The thermal cut-off circuit of claim 14 and further including a pilot light and a pilot circuit having a thermocouple.

21. The thermal cut-off circuit of claim 20 wherein the power source is the thermocouple.

22. The thermal cut-off circuit of claim 14 configured to ensure the gas valve is closed in response to an incomplete combustion condition.

23. The thermal cut-off circuit of claim 14 wherein the ambient thermal switch is positioned in a path of air entering the combustion chamber.

24. A method of controlling a gas water heater including a combustion chamber, a power source, a gas valve, and a thermal cut-off circuit, the thermal cut-off circuit having a thermal cut-off switch and an ambient thermal switch, the method comprising:

providing power to the gas valve;

detecting a first temperature in the combustion chamber;

determining if the first temperature exceeds a first threshold;

detecting a second temperature of air entering the combustion chamber;

determining if the second temperature exceeds a second threshold; and ensuring the gas valve is closed when the first temperature exceeds the first threshold and the second temperature does not exceed the second threshold.

25. The method of claim 24 and further comprising detecting a third temperature in the combustion chamber;

determining if the third temperature exceeds a third threshold; and ensuring the gas valve is closed when the third temperature exceeds the third threshold.

26. The method of claim 25 wherein the third threshold is greater than the first threshold.

27. The method of claim 25 wherein the third temperature is detected from a position below a burner.

28. The method of claim 24 wherein the water heater further includes a pilot circuit having a pilot light and a thermocouple.

29. The method of claim 24 wherein the power source is the thermocouple.

30. The method of claim 24 wherein the first threshold is greater than the second threshold.

31. The method of claim 24 wherein the first temperature is detected from a position below a burner.

* * * * *